United States Patent [19]

Battista

[11] Patent Number: 4,691,917

[45] Date of Patent: Sep. 8, 1987

[54] BI-BRACHIAL MOTIVE SUPPLEMENTING DEVICE

[76] Inventor: Dino Battista, 11900 NE. 16th Ave., N. Miami, Fla. 33161

[21] Appl. No.: 799,554

[22] Filed: Nov. 19, 1985

Related U.S. Application Data

[63] Continuation-in-part of Ser. No. 666,440, Oct. 30, 1984, abandoned.

[51] Int. Cl.[4] ..... A63B 21/00

[52] U.S. Cl. ..... 272/126; 272/119; 128/94

[58] Field of Search ..... 272/73, 93, 119, 125, 272/126, 133, 139; 128/25 R, 26, 77, 94, 68; 2/159, 44, 45, 2

[56] References Cited

U.S. PATENT DOCUMENTS

| | | | |
|---|---|---|---|
| 1,402,179 | 1/1922 | Piscitelli | 272/139 |
| 3,988,020 | 10/1976 | Carter | 272/143 X |
| 4,040,632 | 8/1977 | Pawl | 128/77 X |
| 4,205,666 | 6/1980 | Kapp, Jr. et al. | 128/94 X |
| 4,335,875 | 6/1982 | Elkin | 272/70 |
| 4,382,439 | 5/1983 | Shen | 128/77 |
| 4,447,912 | 5/1984 | Morrow | 128/77 X |
| 4,540,173 | 9/1985 | Hopkins, Jr. | 272/139 |

*Primary Examiner*—Richard J. Apley
*Assistant Examiner*—J. Welsh

[57] ABSTRACT

This invention relates to the field of mechanical devices which are used for providing an enhanced range of motion to users with debilitated musculature, particularly of the arms. It provides a collar mounted behind the users neck with a channel therethrough which channel slidably contains an inelastic member such as a length of woven wire. Each end of the inelastic member is fastened to the distal end or hand of the user's arm (by the user him/herself if possible). By pulling down on one end of the inelastic member, the user is able to raise the arm attached to the other end of the inelastic member. This is particularly useful where the user is a victim of Amyotrophic lateral Sclerosis or muscular dystrophy, for such persons often lack the ability to raise either arm to perform ordinary tasks, such as bringing a forkfull of food to the mouth. The invention also provides for attachments with associated support stay to uncurl the users hands when in use.

10 Claims, 8 Drawing Figures

BI-BRACHIAL MOTIVE SUPPLEMENTING DEVICE

This is a continuation-in-part of co-pending application Ser. No. 06/666,440 filed on 10-30-84, now abandoned.

FIELD OF THE INVENTION

This invention relates to the field of devices which can help disabled or debilitated persons lead more productive lives by supplementing their motive abilities, and more particularly to such devices which enable the arms and hands of people with diminished motor capacity in said brachia to move these upper limbs with efficacy.

This invention is called Dino's Collar by its inventor and much of its basic configuration has been the subject of a disclosure document, held in secret by the Patent and Trademark Office as Disclosure Document No. 118293. The invention has been under continuous development through personal experimentation by the inventor. At no time during this experimental phase did the inventor disclose the inventive concepts described herein to anyone not under an obligation to keep the invention secret. Furthermore the inventor has not, to this date, tested or used the invention in public.

BACKGROUND OF THE INVENTION

Due to diseases such as muscular dystrophy and Amyotrophic lateral Sclerosis, or to traumatic injury or heredity, many individuals cannot lift their arms to their faces to perform mundane tasks such as eating, washing, brushing their teeth and so forth.

This invention teaches an apparatus which enables such individuals to perform such tasks, without the assistance of others.

The inventor himself is afflicted with Amniotropic Lateral Sclerosis (Lou Gherig's Disease), and during the many years which he has been so afflicted he has not found any device which functions as does his invention. Two devices were discovered in a search which do employ a structure around the neck which goes to each hand but neither is capable of performing the functions of this invention. U.S. Pat. Nos. 4,337,938 and 4,335,875 teach that such a neck-supported arm holding device may be used to improve physical exercise and posture but neither show that the downward motion of one arm may be directed to moving the other arm upward.

One of the problems that Amyotrophic lateral Sclerosis (herinafter ALS) victims have to face is a curling-in of the hands. Using a hand support means which holds the hand in a more normal flat (as opposed to claw-like or fist-like) position is therefore essential to such a person. This invention incorporates such a hand support means to attach the user's hand and arm to the rest of the device. Means for immobilizing body parts have been taught in the health care field, the closest known being U.S. Pat. No. 4,013,070 which teaches the use of integrally built support means built into a glove to hold a hand immobile, but said device is not easy for those without proper function to employ. Useful design for the ALS victim (or for those with similar disabilities) requires ease of putting the hand support means on to and taking it off from the hands, a problem which the prior art does not address.

SUMMARY OF THE INVENTION

This invention connects the downward motion of one upper limb through an inelastic (wire) means to supply upward force to the other upper limb by slidably supporting an inelastic member, wire means behind the neck and does so in a manner so arranged and disposed to be most useful and comfortable to persons with the above described problems, and it can do this in an economical way.

Accordingly the primary object of this invention is to provide a device which enables the user to perform ordinary tasks which cannot be done without the raising of an arm to the level of the upper torso or face.

Another object of this invention is to provide such a device at a very small cost.

A further object of this invention is to provide a device which enables the user to transfer the force of the lowering of one limb to the raising of the other.

A still further object of this invention is to provide a means for supporting "palsied" hands in useable positions and at the same time connecting said supported hands to a device which enables the user to raise one hand by the lowering of the other.

Other objects and uses of the invention will become apparent when the detailed description is read in conjunction with the drawings in a manner limited only as set forth in the claims.

DETAILED DESCRIPTION OF THE PREFERRED EMBODIMENT

Figure 1:
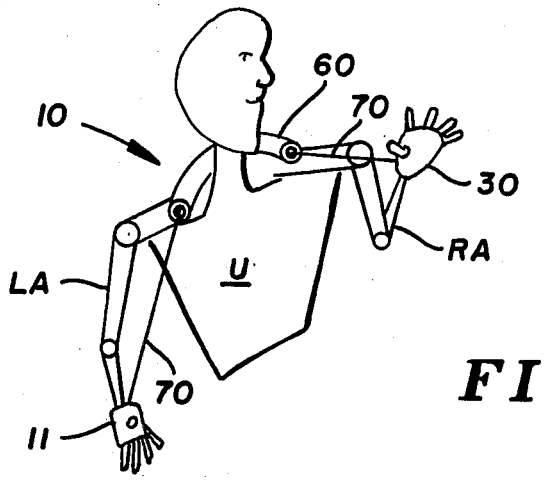
FIG. 1 is an illustration of the preferred embodiment of the device as it functions in connection with a user.

Referring to FIG. 1 to describe the basic fuction of the invention, the preferred embodiment is referred to generally with the numeral 10, on a user U, with wire means 70 being pulled through collar 60 by the downward motion of left arm LA, resulting in the upward movement of right arm RA. Both hand support means 11 and hand support means 30 are connected to the inelastic wire means 70 by a hook and eye attachment described below.

Both hands would be expected to be attached in similar manners, but where one is missing the downward motion of that arm could still be employed to raise the other arm by a suitably adapted arm holder.

Figure 2:
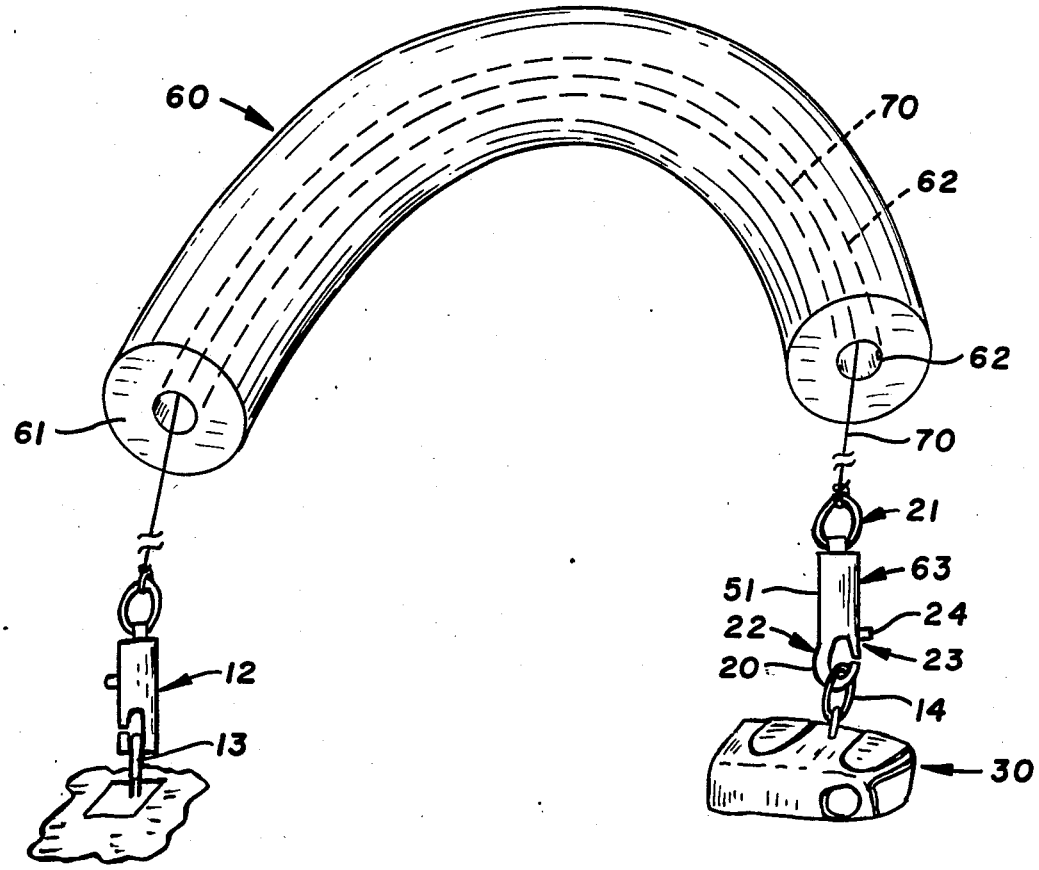
FIG. 2 is a front view of the device.

Referring now to FIG. 2 in which Dino's Collar 10 is shown in more detail, the structure can be seen to basicly comprise a collar 60, with stiffening means 62 extending therethrough, and an inelastic wire means 70 which is threaded through the opening in each side of the collar. Said wire means 70 is firmly connected to attachment means 63 and 12 at each end. Said attachment means 63 and 12 may be releasably attached to a compatible attachment means such as eye means 13 and 14 in the preferred embodiment, which eye means are firmly mounted on the hand support means (30).

In construction the collar 60 is a soft rubber or formed foam structure comfortable to the users neck. The stiffenning means 62 provides a firmness to the structural element while at the same time providing a channel in which the wire means 70 may slide easily. Ease of sliding is important so that the limited strength of the downward force available to the user is not wasted on friction. The least expensive means found by this inventor to provide these features in these elements is to use a foam rubber tube 61 for collar 60 into which a length of ½" pipe is slid, to form the stiffening means 62, said pipe being a channel through which a woven metal wire will easily slide. A foam plastic collar with a plastic internal channel might also be used with a nylon line within.

At each end of wire means 70, is an attachment means 63, comprising generally a swivel means 51, to which swivel means is firmly attached wire means 70 at one end 21 and at its other end 22, releasing hook 20. The releasing hook must be large enough to be easily opened and closed by the user, and a clipping closed hook means with a catch and a closer might be preferable to the one illustrated in the preferred embodiment having a spring mounted closer 23 with attached handle means 24 for the reason that it might be easier to use. The user's particular preference should be the guide to swivel type employed in the attachment means.

Figure 3:
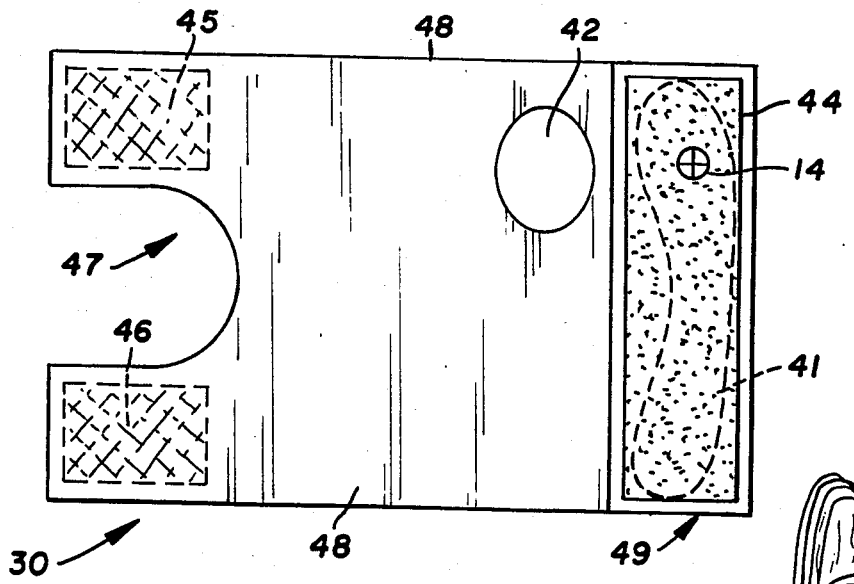
FIG. 3 is a top view of an open hand support means.

FIG. 3 shows the right hand support means 30 laid out flat. Metal plate 41 is shown in dotted outline to describe its position. This stay (in the preferred embodiment, metal plate 41) may be of a material other than metal provided it can perform the support function which it must accomplish, to wit, keeping the user's hand in a relatively open position.

When folded onto the hand of the user, hand support means 30 is held to wire means 70 by its connection to attachment means 63 at releasing hook 20 with eye means 14. Eye means 14 may be connected to metal plate 41 or to the leather like material 48 which forms the preferred substrate of the hand support means 30. This material 48 should be strong but pliable and comfortable and may be shaped more like a glove, in the way it fits around the hand, if preferred.

Figure 4:
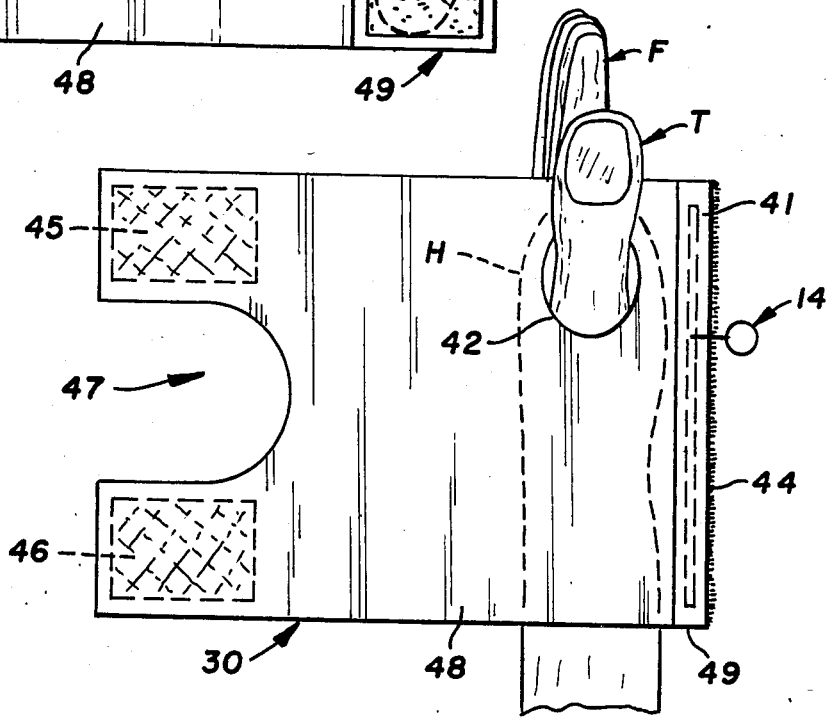
FIG. 4 depicts said hand support means being connected to a user's hand.

In FIG. 4 the hand support means 30 is seen being so folded, with metal containing portion 49 being over the back of the hand H, and thumb T protruding through aperture 42. Indentation 47 is provided in a shape which will fold easily over the metal containing portion 49, even with only the extremely limited dexterity of the user, and it is also in a shape which avoids entanglement or interference with eye means 14. When fastening means 45 and 46 are brought in contact with the fastening means 44 on the outer surface of metal containing portion 49 said fastening means should connect and hold but be easily releasable by the user. The trade product Velcro has been found by the inventor to be well suited to this end.

Figure 5:
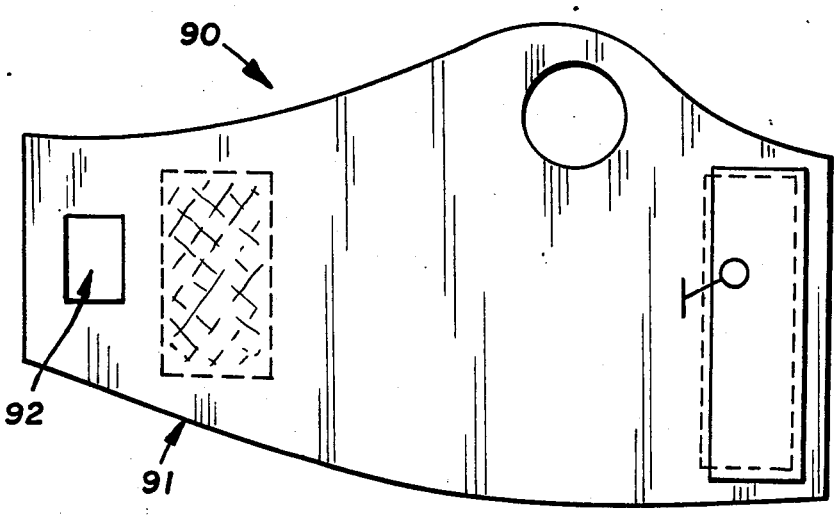
FIG. 5 illustrates an alternate hand suport means embodiment

An alternate embodiment for the hand support means is referred to with numeral 90 in FIG. 5. This embodiment 90 is for patients with more than minimal dexterity, and employs a single flap 91 with an aperature means 92 therein to allow eye means 93 to pass therethrough for closure.

The preferred embodiment as described above should not be considered the limit of the invention. For example, with reference to the hand support means 30, while the use of a flexible material may be the simplest to construct for surrounding and supporting the user's hand, it should be clear that there are other other structures which could accomplish this function. For example, the preferred embodiment may employ a molded or extruded plastic with sufficient rigidity to support the user's hand in an open position. Such an embodiment of the hand support means would have to have an opening of sufficient size to allow the user to push his hand into the hand support means. Likewise it would have to be of sufficient length to reach from the user's wrist to the base of the fingers in order to keep the hand in an open position. (Of course, where the user is not afflicted with the claw-like curling-in of the hands, this second requirement would be an unnecessary limitation. In cases where the user may be missing a hand, use of a tight fitting ring or similar "hand support means" equivalent obviously would be more appropriate.) Another structure which will provide a satisfactory hand support means would be a flexible but not easily stretchable material to which a flat rigid plate is affixed either over the back of the hand or the palm.

Attachment of the wire means or inelastic member, which extends from one hand support means to the other, may be accomplished in numerous ways also. Use of the swivel attached to the eye means as described above is probably the most flexible approach and best structure, but direct attachment to the hand support means may also be used. If the the metal or rigid plate of the first described hand support means is located over the back of the hand then attachment to it would be the obvious choice. (Attachment could be made by soldering, for instance.) Likewise an inelastic structure could be sewn into the outer side of the surface of the hand support means, and to this inelastic structure, the wire means or inelastic member could be permanently attached. Also, if a sufficiently rigid plastic is used to form the hand support means, an attachment means, for instance a loop of the same material, may be formed on the upper outer surface for attachment of the inelastic member thereto.

Generally, it should be recognized that the user will be using the device described in this patent for daily activities such as getting around and eating. Accordingly it is sensible to use materials and construction which is resistant to water. Stainless steel for instance may be used for the wire means or inelastic member and for the supporting plate in the hand support means. Nylon or other man-made fibers may be used for the hand support means flexible material and also for the wire means or inelastic member. (However, in this case, the material chosen for the channel which carries the elastic member through the collar, the stiffening means, whether stiff or not) must, as previously mentioned, allow for easy slidablity of the inelastic member through the channel.

It may also be noted that the stiffening means through which the inelastic member passes provides for protection of the soft (or foam) rubber or rubbery material of the collar from the inelastic member. It also keeps the inelastic member from being felt at the back of the users neck by virtue of the fact that the soft material is kept between the inelastic member and the users neck.

Figure 6:
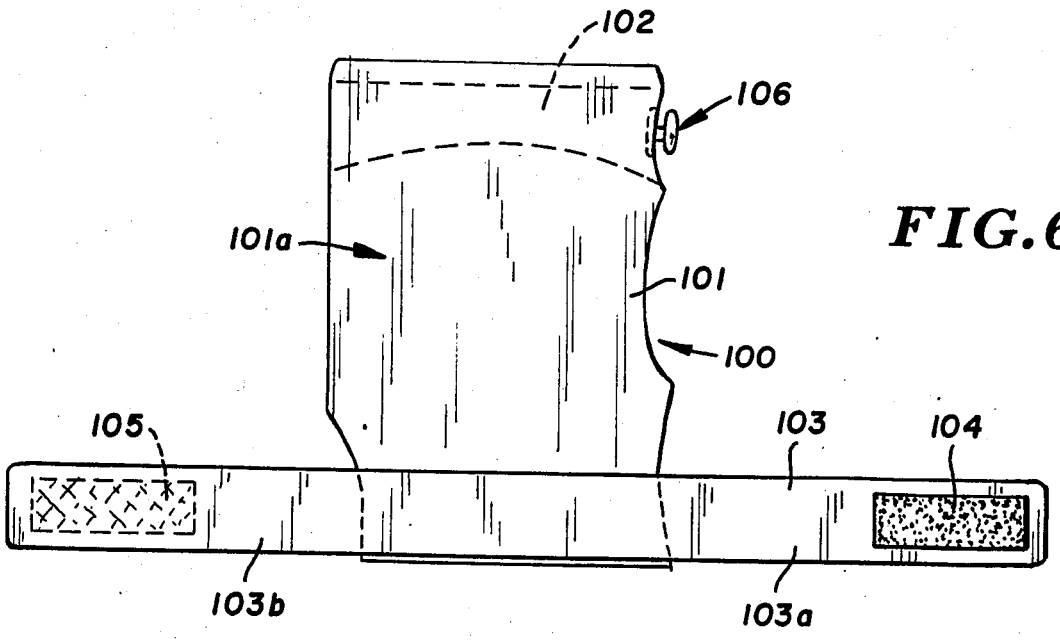
FIG. 6 is an underside view of another alternative hand support embodiment

An actual alternative preferred embodiment for the hand support means can be described with reference to FIGS. 6, 7 and 8, generally described with the reference numeral 100. Refer first to FIG. 6 in which the alternative embodiment for the hand support means 100 is shown unattached to the inelastic means. It 100 is constructed of a unitary rigid body 101 with an exterior surface 101*a* and an interior surface 101*b* (FIG. 7), the body 101 most effectively being a molded plastic taken from an impression of the intended user's hand, but other rigid or inflexible materials of suitable size will suffice. Above the interior surface 101*b* is a back of the hand retaining member 102, integrally formed with the rest of the unitary body 101, and spaced apart from the interior surface a sufficient distance to allow the intended user to slip his or her hand into the hand support means 100, but close enough to the interior surface to allow little freedom of movement perpendicularly away from member 102 or surface 101*b*, when the user's hand is inserted therebetween.

At the opposite end of body 101 and mounted by glueing or other suitable firm fastening means is a flexible strip 103, having a thumb side origin part 103*a* and an opposite thumb side origin part 103*b*. On part 103*a* is mounted contact fastening means 104 and on part 103*b* is mounted mating contact fastening means 105. For purposes of illustration, the trade product Velcro has been found by the inventor to be a suitable contact fastening means, although it is believed that other means such as buttons, snaps et cetera may be used.

A rivet 106 is used with this embodiment to fasten the elastic means to the hand support means. A detai of this rivet is shown in FIG. 8. It is constructed from a base and shaft 110 which are inserted through member 102 at substantially the location shown in FIG. 6, and a cap 111 into which the shaft 110*a* is forced under pressure, the shaft 110*a* expands at the tip to seccurely and firmly secure itself to the cap 111. (Alternatively, rivet 106 could be constructed of a single piece; or as a second alternative, shaft 110*a* could be threaded and mounted into a threaded cap and held in permanent connection by glue.) In any event, the undersurface of cap 111 should not fit snugly against member 102, rather a space on the order of 1/32 of an inch should be left for the wire 112 to have clearance. With such clearance, the wire 112 (the preferred inelastic means for this embodiment) may swivel about the shaft 110*a* of rivet 106. The wire 112 should be made with a loop 114 larger than shaft 110*a* and smaller than the diameter of the cap 111. It may be formed by a weld at point 113, a braid or a knot.

Figure 7:
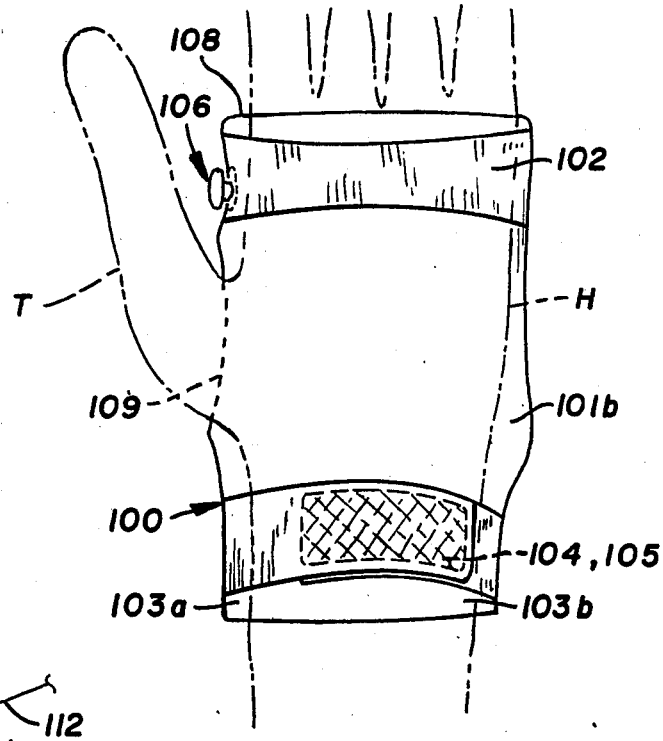
FIG. 7 is an illustration of the embodiment of FIG. 6 when viewed from the opposite side depicting its fit with a user's hand
Figure 8:
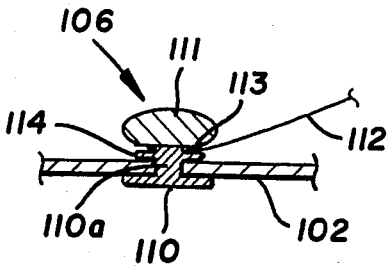
FIG. 8 depicts a cross-sectional view of a rivet.

Refer now to FIG. 7, wherein the hand support means 100 is illustrated with a hand H of the user situated therein. In this illustration it can be seen that inner surface 101*b* ends at a line 108 just below the user's finger line. It can also be seen that a cut-out area 109 is provided to allow for more freedom of movement of the user's thumb T. Parts 103*a* and 103*b* are folded over the user's arm so that the contact fastening means and mating contact fastening means 104 and 105 secure the underside of the user's arm to the inner surface 101*b*. It is believed that the most effective location for the flexible strip 103 is approximately three inches below the user's wrist.

What is claimed is:

1. An arm movement enhancing device capable of providing users who cannot otherwise raise their arms to functional positions, the ability to raise either arm by the application of downward force to said device by the opposite arm, wherein said device comprises:

an inelastic member having a length and two ends, a collar, short enough to allow the hands of the user to come into proximate association with the user's face when worn on the user's neck, which during use is so arranged and disposed to be capable of being comfortably worn by the user at the back of said user's neck said collar comprising;

channel means therethrough with an opening at each end of said channel means wherein a portion of the length of said inelastic member is slidably contained within said channel means and one of said inelastic member ends extends from one of said openings and the other end extends from said other opening, and wherein said openings are positionable such that one opening is on one side of the head of the user and the other is positionable at the other side of the head, and wherein said channel means further comprises a stiffening means for providing a firmness to the shape of said collar and so arranged and disposed with respect to said collar so as to provide for the comfortability to the user and so as to interfere with the slidability of said inelastic means, cushioning means so arranged and disposed to fit against the neck of the use, being comfortably shaped to be supportable thereon by said channel means and stiffening means, a right and a left attachment means for attachment of the right and left arms of the user, respectively, connected to that end of said inelastic means which is on the right or left side of the user, respectively.

2. A device as set forth in claim 1 further including at least one hand support means wherein at least one of said attachment means is attached thereto and wherein said hand support means contains a substantially rigid plate so arranged and disposed to prevent the hand of the user from curling inwardly when inserted into said hand support means.

3. A device as set forth in claim 2 wherein said hand support means further comprises a flat sheet of flexible material with a aperture so arranged and disposed to fit the user's thumb, and contact fastening means so arranged and disposed to provide easy entrance and egress of the user's hand into and out of said hand support means.

4. A device as set forth in claim 3 wherein said flexible material is leather.

5. A device as set forth in claim 3, wherein said attachment member comprises swivel means having two sides, one of which is firmly attached to one of said inelastic member ends, and the other side of which is a releasable swivel attachment member for releasable connection to said hand support means.

6. A device as set forth in claim 5, wherein said releasably connected hand support means comprises a sheet of flexible material for binding about the hand of the user, held in position about said hand by the tension created when bound about said hand and fastened thereon by said contact fastening means (being formed of two members which hold together when brought into contact with one another) so arranged and disposed on two locations on said sheet which are in contact with one another when the user's hand is bound in said sheet so as to be fastenable and unfastenable with the other of said user's hands by bringing said two locations of said sheet into or out of proximity, and wherein said hand support means further comprises a hand support attachment member for releasable connection to said swivel means.

7. A device as set forth in claim 6, wherein said hand support attachment member for releasable connection to said swivel means comprises an eye means connected to said sheet to receive said releasable swivel attachment member and wherein said swivel member is an openable hook means comprising a substantially ring shaped member which may be opened for insertion of the eye means into said ring, and may be closed around said eye means so as to make a connection therewith, and may be reopened to release the connection so made.

8. A device as set forth in claim 1 wherein said channel means comprises a metal pipe and wherein said inelastic member comprises a length of wire.

9. A device as set forth in claim 1 wherein at least one of said attachment means comprises;

a rigid body having an interior and an exterior surface and having a retaining member for fitting over the back of the user's hand, said interior surface being shaped to fit beneath the user's palm and wrist and having a thumb side and a side opposite said thumb side, a flexible strip mounted to said exterior surface at a point which is below the user's wrist, having parts extending beyond said rigid body to the thumb side and to the side opposite said thumb side, each part having contact fastening means and being so arranged and disposed so that the fastening of said contact fastening means operates to strap the arm of the user to said interior surface below the user's wrist, said inelastic member is a metal wire and, a rivet having a shaft and a cap, fastened through said retaining member such that a loop in said wire fastened around the shaft of said rivet may rotate about said shaft between said retaining member and said cap 10. The method of using the apparatus of claim 1 comprising: placing the apparatus around the back of a user's neck so the cushion means of the collar engages said user's neck, attaching one attachment means to one hand of said user and attaching the other attachment means to the other arm of said user, raising the one hand by exerting a downward force with the other arm so said inelastic member slides through said channel means, whereby said one hand is raised to a functional position in proximity to said user's face.

* * * * *